United States Patent [19]

Campana et al.

[11] Patent Number: 4,832,703

[45] Date of Patent: May 23, 1989

[54] FUEL PACKAGE

[75] Inventors: Patsie C. Campana; David L. Campana, both of Lorain, Ohio

[73] Assignee: Caldo International, Inc., Lorain, Ohio

[21] Appl. No.: 112,383

[22] Filed: Oct. 22, 1987

[51] Int. Cl.[4] ..... C10L 5/00; C10L 11/06

[52] U.S. Cl. ..... 44/519; 44/532; 44/533; 44/541

[58] Field of Search ..... 44/38–41, 44/519, 532, 533, 541; 126/206, 263

[56] References Cited

U.S. PATENT DOCUMENTS

| | | | |
|---|---|---|---|
| 1,401,803 | 12/1921 | Lynes | 44/40 |
| 2,548,379 | 4/1951 | Lammersen | 44/40 |
| 2,666,695 | 1/1954 | Brody | 44/40 |
| 2,834,661 | 5/1958 | Chaplin | 44/40 |
| 3,252,770 | 5/1966 | Fearon | 44/40 |
| 3,269,807 | 8/1966 | Key | 44/40 |
| 4,013,061 | 3/1977 | Trumble et al. | 44/40 |
| 4,074,977 | 2/1978 | Dunham et al. | 44/38 |
| 4,101,292 | 7/1978 | Hogan | 44/40 |
| 4,460,377 | 7/1984 | Kalil | 44/40 |

FOREIGN PATENT DOCUMENTS

| | | | |
|---|---|---|---|
| 1957368 | 5/1971 | Fed. Rep. of Germany | 44/40 |

*Primary Examiner*—Carl F. Dees

*Attorney, Agent, or Firm*—Fay, Sharpe, Beall, Fagan, Minnich & McKee

[57] ABSTRACT

A self-kindling fuel package includes a readily combustible container having four side walls and a bottom wall. A charge of fuel is held in the container together with an igniting member for igniting the charge of fuel. The igniting member includes a wick, an ignition element to which the wick is secured and an ignition cream which is applied to a surface of the ignition element. The ignition cream is in contact with a portion of the wick for igniting the ignition element.

27 Claims, 4 Drawing Sheets

FUEL PACKAGE

BACKGROUND OF THE INVENTION

This invention generally pertains to fuel packages. More specifically, the present invention relates to a fuel package which is of the self-kindling variety.

The invention is specifically applicable to fuel packages which can be utilized in a charcoal grill or the like. However, it should be recognized that the fuel package can be used for starting a wood fire in a wood stove or a fireplace and can also be utilized for starting campfires and the like.

The use of charcoal briquets and similar fuels for outdoor cooking such as barbecues has become widespread. Charcoal and charcoal lighter fluid has therefore been put on sale in grocery stores and similar retail establishments so that it may be purchased together with food. However, the conventional packaging of charcoal briquets is in relatively large and heavy, awkward to handle paper bags. This has proven to be troublesome for a variety of reasons. First, the transfer of charcoal briquets from the paper bag to a grill is a messy and dirty operation. Second, the charcoal is difficult to kindle even when using a conventional charcoal lighter fluid.

Conventional charcoal briquets are normally ignited by dousing the charcoal with lighter fluid, allowing the fluid to soak into the briquets and then igniting the pile of briquets with a match. Once ignited, the fluid must burn away and the charcoal must be allowed to smoulder to a point where the charcoals are hot enough to provide sufficient heat for cooking. The procedure is generally rather time consuming, and if there is any sort of wind, it is quite difficult to start, particularly where the fire is in the open and without shelter. Also, in some instances, if the charcoals are slow to heat up, a person will pour on additional amounts of lighter fluid in an attempt to encourage the fire. This is an extremely dangerous procedure and many people are severely burned each year from uncontrolled fires and explosions resulting from this practice. Also, sometimes a petroleum taste is imparted to the food cooking on a charcoal fired grill by the lighter fluid used.

In general, the phase of kindling the charcoal and starting the fire is considered a dirty, messy, and potentially dangerous job and one to be passed on to someone else whenever possible. Hence, people are frequently deterred from building a charcoal fire not only because of the inconvenience of handling large paper bags of briquets but also because of the possibility of causing injury to themselves in lighting the fire or in tinkering with the fire in order to make sure that the charcoal is burning properly.

Another difficulty encountered frequently by inexperienced barbecue cooks is that they either use too little charcoal and have to add more, cooling the fire and interrupting the cooking, or they use too much and consequently end the cooking process with a roaring fire much too hot for satisfactory cooking thereby wasting a large amount of fuel. A proper charge for the average barbecue grate is one which will burn down to an evenly glowing bed of coals and will continue in such condition long enough to cook two servings.

While there are some self-kindling fuel packages available on the market, none of these has proven to be particularly clean, easy to use, and inexpensive.

Accordingly, it has been considered desirable to develop a new and improved fuel package construction which would overcome the foregoing difficulties and others while providing better and more advantageous overall results.

BRIEF SUMMARY OF THE INVENTION

In accordance with the present invention, a new and improved self-kindling fuel package is provided.

More particularly in accordance with the invention, the package comprises a container, a charge of fuel held in the container, and an igniting means positioned in the container for igniting the charge of fuel. The igniting means comprises a wick, an ignition element to which the wick is secured, and an ignition cream applied on a surface of the ignition element, and in contact with a portion of the wick, for igniting the ignition element.

In accordance with another aspect of the invention, the container has four side walls and a bottom wall. The container comprises a first element including front and rear walls and side walls connecting the front and rear walls and a second element including front and rear walls and a bottom wall. The second element is secured to the first element.

According to another aspect of the invention, the container has four side walls and a bottom wall and comprises three elements secured together. A first element includes front and rear walls and a side wall connecting the front and rear walls. A second element includes front and rear walls and a side wall connecting them. A third element includes front and rear walls and a bottom wall connecting them.

According to another aspect of the invention, the package further comprises a wrapper enclosing the container and the charge of fuel held therein.

According to a further aspect of the invention, the ignition element consists essentially of a reactive mixture of silica, sodium nitrate, sodium hexafluorosilicate, aluminum and iron oxide.

According to still another aspect of the invention, the second element bottom wall is narrower than the distance between the first element side walls so that a pair of spaced slots is formed in the container for allowing air to enter the container. Preferably, the pair of spaced slots is provided adjacent a bottom surface of the container to allow air to flow upwardly through the container and out an open top end thereof.

According to a still further aspect of the invention, the second element is positioned inside the first element so that each of the second element side walls is disposed adjacent a respective one of the first element side walls and wherein the invention further comprises a fastening means for securing the second element to the first element.

According to yet another aspect of the invention, the package further comprises a flue means provided in the container with the flue means extending upwardly from a bottom surface of the container.

According to still yet another aspect of the invention, the charge of fuel comprises a plurality of loose discrete pieces of fuel located in the container.

According to yet still another aspect of the invention, the wrapper is flammable and substantially dust proof to prevent dust particles of the pieces of fuel from escaping from the container.

One advantage of the present invention is the provision of a new and improved fuel package capable of use in any of the ordinary types of barbecue grills as well as fireplaces, wood stoves, camp fires, and the like.

Another advantage of the present invention is the provision of a fuel package which is clean, easily handled, kindles rapidly and contains a unitary charge of a fuel substance such as charcoal.

Still another advantage of the present invention is the provision of a fuel package which obviates the necessity for the user to come in contact with the charcoal contained therein and which can be ignited without the use of extraneous kindling material.

Yet another advantage of the present invention is the provision of a fuel package which is contained in a sufficiently rigid container for easy handling and wherein the entire package can be consumed by the fire.

A further advantage of the invention is the provision of a fuel package which contains flow passages to permit the circulation of air for a flue effect and which is easily ignitable even in windy conditions.

A still further advantage of the present invention is the provision of a fuel package which uses an inorganic igniter for hot burning so as to readily kindle a fire in the fuel contained in the package, and provide a higher cooking temperature thereby locking in the flavor of food being cooked, yet which is safe and can be employed without risk.

A yet further advantage of the invention is the provision of a fuel package which contains an adequate amount or charge of a charcoal fuel to cook food for a suitable time at a suitable cooking temperature and in which the flavor of the food will not be deleteriously affected by a petroleum taste, as from a liquid lighter fluid. The size of the package can vary depending on the number of meals intended to be cooked.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENTS

Figure 1:
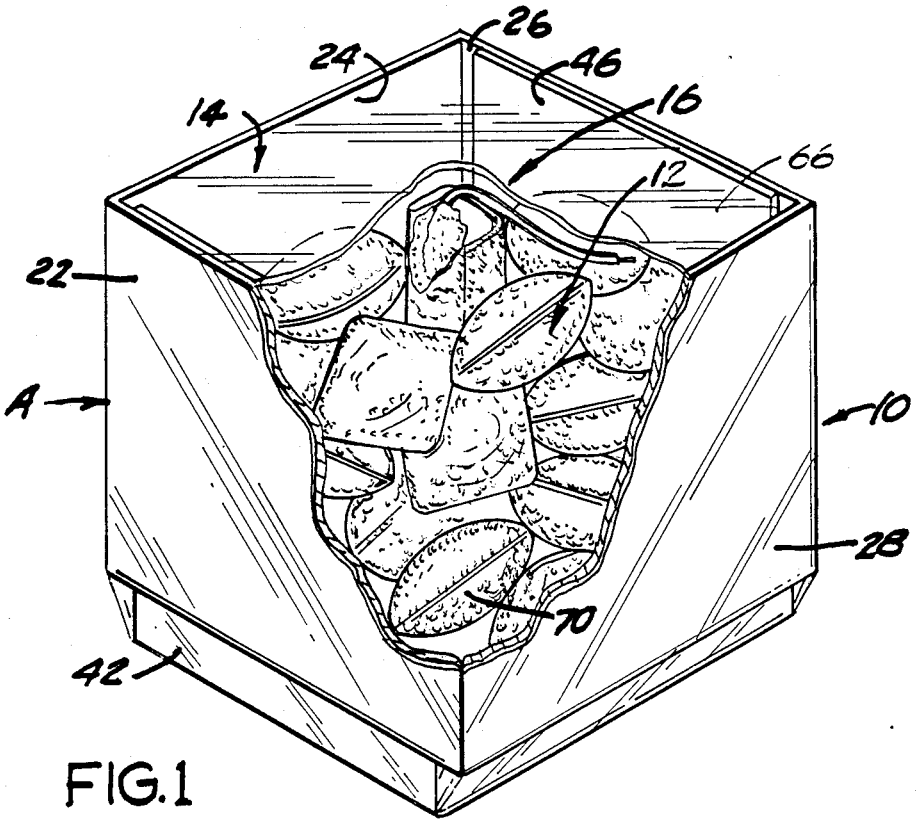
FIG. 1 is a perspective view, partially broken away, of a self-kindling fuel package according to the present invention.

Referring now to the drawings wherein the showings are for purposes of illustrating a preferred embodiment of this invention only and not for purposes of limiting same, FIG. 1 shows the subject new fuel package A. While the fuel package is primarily designed for and will hereinafter be described in connection with its use on a barbecue grill for kindling a charcoal fire thereon, it will be appreciated that the overall inventive concept involved could be adapted for use in other environments where it is desired to start a fire such as in a wood stove, in a fireplace, or in campfires.

More particularly, the fuel package A comprises a basket or container 10 which houses therein a charge of fuel 12. A wrapper 14 encloses the charge of fuel as well as an igniting means 16. Both the container 10 and the wrapper 14 are entirely combustible, as is the igniting means 16. Preferably, the wrapper seals the container 10 in a dustproof manner in order to prevent dust from the charge of fuel 12 from falling out of the package, or, if the package is inverted the charge of fuel from falling out of the package.

Figure 2:
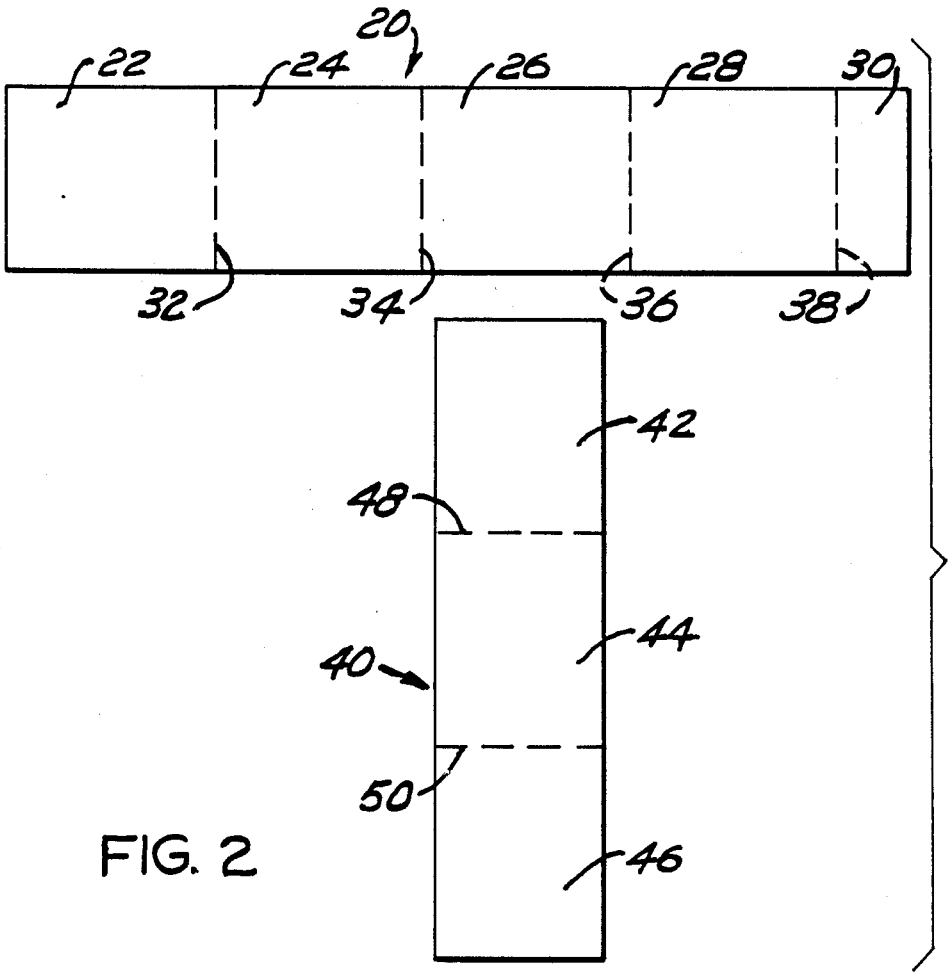
FIG. 2 is a top plan view of two elements which comprise a container of the fuel package of FIG. 1 with the elements in an unfolded state.

With reference now to FIG. 2, the container 10 in one preferred embodiment comprises an approximately cubical structure formed from two elements. A first element 20 is provided which, in its unfolded state, includes a first panel 22, a second panel 24, a third panel 26, a fourth panel 28, and a flap 30. A plurality of respective fold lines 32, 34, 36, 38 are provided between the several, preferably equally sized, panels to enable the first element to be folded into a substantially square configuration thereby forming the four side walls of the container.

The container further comprises a second element 40 which includes first, second, and third panels 42, 44, and 46 as well as a pair of fold lines 48, 50 positioned therebetween. The fold lines enable the second element panels to be folded in relation to one another so that they can constitute a pair of side walls and a bottom wall for the container. It should, of course, be recognized that other container configurations could also be provided for the fuel package, as desired.

Figure 3:
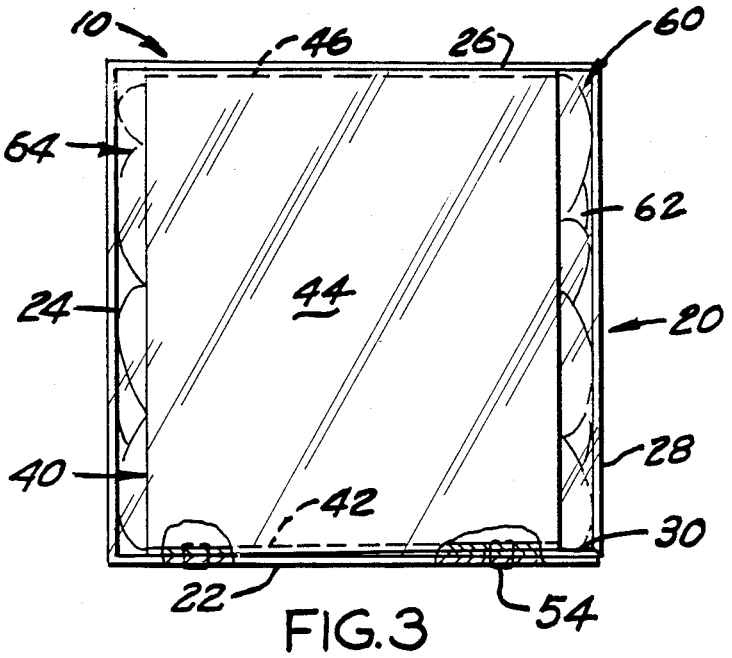
FIG. 3 is a bottom plan view of the fuel package of FIG. 1.

With reference now to FIG. 3, when the first element 20 is folded for use, it will comprise the four side walls of the container. When the second element 40 is folded, it will comprise a bottom wall, formed by the second panel 44 thereof, as well as a pair of additional side walls for the container. It is evident from FIG. 1 and 3 that the length of the second element second panel 44 is suitably shorter than the width of the first element first and third panels 20, 24 so that the second element, when folded, can be slipped inside the first element.

In order to secure the first and second elements together, as well as to secure the flap 30 of the first element to the first panel 22 thereof, one or more fasteners 54 can be provided. The fasteners can be staples or another suitable type of conventional fastener. If desired, however, instead of using fasteners, a combustible and non-toxic adhesive, such as a suitable conventional glue could also be provided. While two staples 54 are illustrated on one side of the container, similar staples could also pass through the adjoining panels 26, 46 on the other side of the container to secure them together. While the rest of the package is combustible, the staples, since they are conventionally made of metal, will not be consumed in the fire. However, since the staples are relatively small in size and since only a few are necessary, they will not pose an obstacle to the fire or present a cleanup problem afterwards.

As is evident from FIG. 3, the width of the second element second panel 44 is less than the width of the first element second and fourth panels 22, 26 so as to provide a flue means 60 adjacent the bottom surface of the container. The flue means 60 comprises first and second spaced slots 62, 64 through which air may flow to aid combustion once the fuel package is ignited. The second element first and third panels 42, 46 are preferably somewhat longer than the first element first and third panels 22, 26 as best shown in FIG. 1. Thus, the slots 62, 64 extend between the container bottom wall 44, as well as the bottom sections of the second element first and third panels 42, 46, and the first element second and fourth panels 24, 28 which constitute two of the side walls of the container 10. This construction allows easy access for the air into a bottom portion of the container from both the side wall and the bottom wall of the container.

The air will flow out through an open top 66 of the container 10 as is illustrated in FIG. 1. If desired, the wrapper 14 can be transparent so that the contents of the container can be viewed through the open top of the container.

The charge of fuel 12 in the container 10 preferably comprises a plurality of separate loose discrete pieces of fuel 70 which can be charcoal briquets or another suitable conventional fuel. Preferably, the container 10 is generally cubic in shape. This is considered advantageous since the time for ignition of the briquets 70 is related to their distance from the igniter. Thus, a fuel package which is relatively close in shape to the ideal spherical shape, such as a cube, should theoretically ignite the greatest amount of the briquets in the fuel charge in the shortest period of time.

Figure 5:
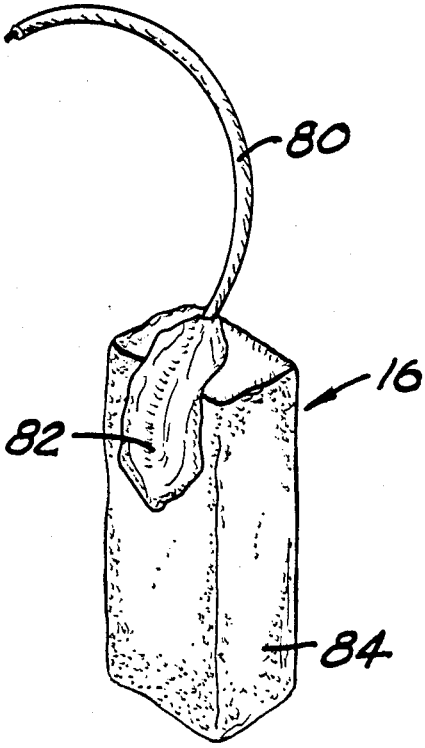

With reference now to FIG. 5, the igniting means 16 which is positioned in the container can comprise a wick 80, a coating of an ignition cream 82 (which also serves as an adhesive means for securing the wick at one end to the igniter) and an ignition element 84. The igniting means 16 is preferably inserted into the middle of the charge of fuel 12 as is illustrated in FIG. 1 so as to provide even heat for the entire charge of fuel when ignition occurs. When properly inserted, only a distal end of the wick 80 extends above the top layer of charcoal 70 in the container 10.

The main component of the igniting means 16 is the ignition element 84. In practice, the ignition element is fabricated from a special mixture of materials which include in weight percent from about 25 to about 65 percent silica, from about 5 to about 18 percent sodium nitrate, from about 1 to about 8 percent sodium hexafluorosilicate or cryolite, from about 15 to about 40 percent aluminum, and from about 2 to about 20 percent iron oxide.

The iginition element is produced from a thermite type of material ($A1 + Fe_2O_3 \rightarrow A1_2O_3 + 2Fe$) to which has been added various other materials for the purpose of controlling the rate of the thermite reaction. In this regard, the above described formulation results in an ignitor element which is exceptionally well suited for the practice of the instant invention. In the proper circumstances, it may be possible to control the rate of the thermite reaction by using materials other than those specified above. For example, various clays or charcoal may be substituted for the silica. The individual components which make up the ignition element are mixed together with a suitable binder, such as sodium silicate, and formed into the desired configuration by conventional means.

The preferred composition used as the ignition element comprises, in weight percent, about 50.0 percent silica, about 12.0 percent sodium nitrate, about 4.0 percent sodium hexafluorosilicate, about 29.0 percent aluminum and about 5.0 percent iron oxide.

The particle size of the various components of the ignition element are selected so that upon ignition, the ignition element burns at a relatively slow rate, generally at a rate about 1 inch per 40 seconds. In the practice of the present invention, a burning rate of from about 5 to 60 seconds per inch is desirable with excellent results being achieved when the burning rate ranges from about 30 to 50 seconds per inch.

The particle size of the silica is such that at least 90 percent passes through a 20 mesh Tyler screen. In practice, the silica component is made up of two different mixes of silica particles. For example, a typical silica formulation comprises 90% of type A silica (as defined below) and 10% of type B silica (as defined below).

Type A Silica

About 0.8–1.0% retained on a 20 mesh screen
About 27.0% retained on a 30 mesh screen
About 62.0% retained on a 40 mesh screen
About 10.0% retained on a 50 mesh screen
About 0.2% retained on a 70 mesh screen
About trace retained on a 100 mesh screen
About trace retained on a 140 mesh screen Type B Silica About 0.3% retained on a 20 mesh screen
About 5.8% retained on a 30 mesh screen
About 21.4% retained on a 40 mesh screen
About 44.8% retained on a 50 mesh screen
About 21.5% retained on a 70 mesh screen
About 3.8% retaned on a 100 mesh screen
About 1.6% retained on a 140 mesh screen
About 0.8% retained on a 200 mesh screen Both the sodium nitrate and the sodium hexafluorosilicate are sized such that they essentially all pass through an 80 mesh screen.

The iron powder is usually sized such that it passes through a 100 mesh screen.

The aluminum power is sized such that it has a particle size ranging from about 0.01 to about 4.0 mm.

The various components of the ignition element are mixed together and formed into the desired shape using a suitable binder. A typical binder is sodium silicate.

The ignition temperature of the ignition element is in the range of about 1500° F. to about 2000° F. The preferred temperature is about 1750° F. Upon ignition, the ignition element produces a temperature of about 2750° F. By utilizing an ignition element of this type, it is possible to efficiently ignite a fuel such as charcoal, which is used for the purposes hereinbefore described.

In practice, an ignition cream (which will ignite at a low temperature such as that generated by a match) is applied to at least a portion of the surface of the ignition element. A typical ignition cream comprises a mixture, in weight percent, of from about 1 to about 40 percent potassium nitrate, from about 1 to about 40 percent sodium nitrate, from about 1 to about 40 percent atomized aluminum, from about 10 to about 30 percent iron powder, from about 10 to about 50 percent titanium powder together with a suitable binder such as from about 10 to about 30 percent cellulose acetate.

The ignition cream will preferably be ignited at a temperature of from about 500° F. to about 1000° F. and generate from about 2000° F. to about 3000° F. when burning. In one preferred embodiment, the ignition cream is ignited at a temperature of approximately 650° F. and burns at a temperature of approximately 2300° F.

In addition to serving as the ignitor for the ignition element, the ignition cream 82 serves to bond the wick 80 to the ignition element 84.

Various sizes of fuel packages can be contemplated for different applications. For example, for a home barbeque a fuel package containing approximately 2 to 4 lbs. of charcoal should be adequate. On the other hand, for an institutional barbeque such as a college dorm or military base barbeque, larger fuel packages containing up to 40 lbs. of charcoal could be provided. If desired, the fuel package can contain mesquite, hickory, or the like to provide a desired taste to the food being cooked.

Figure 4:
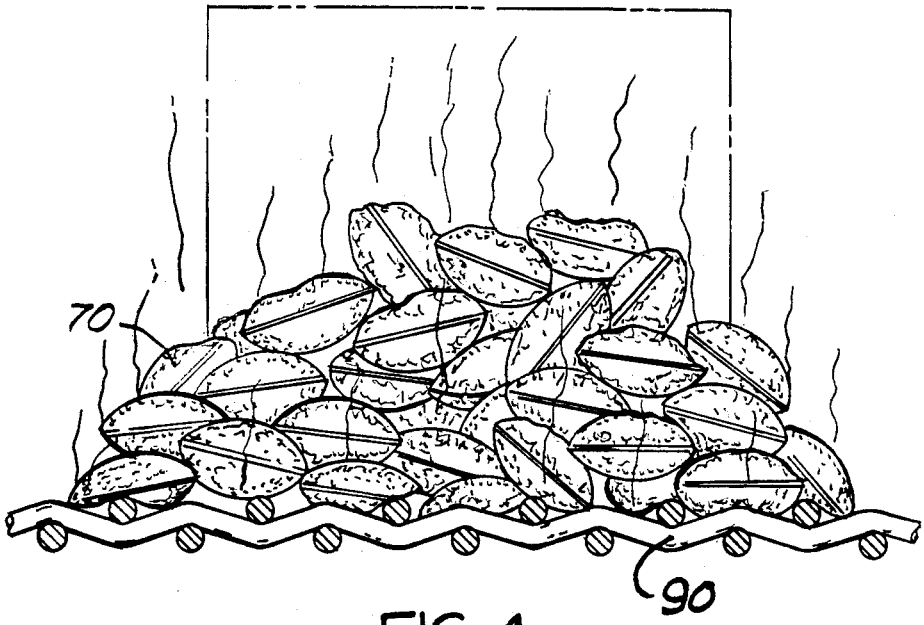
FIG. 4 is a side elevational view of the fuel package of FIG. 1 after the container thereof has been completely consumed, the container itself being shown in phantom lines as it existed before it was ignited; and, FIG. 5 is an enlarged top plan view of an igniting means of the fuel package of FIG. 1.

In use, the fuel package A is positioned on a charcoal grill surface 90 as illustrated in FIG. 4. The wrapper 14 is torn off and the wick 80 is ignited by use of a conventional match, lighter, or the like (not illustrated). However, if the entire wrapper is not removed, that presents no serious problem since the wrapper is also combustible. It is advantageous to remove the wrapper at least in the area of the spaced slots 62,64 to allow air to flow therethrough, although the package will burn without air passing through these slots, albeit at a slower rate. Thereafter, the wick burns down and sets fire to the ignition cream which burns at a high temperature such as 1000-3000° F., and will accordingly set fire to the igniter which burns at a temperature of approximately 2000-2750° F. and will, in turn, set fire to the charcoal briquets 70 of the charge of fuel 12.

The charcoal briquets will ignite concentrically outwardly from the igniter element and then set fire also to the container 10. As the container 10 burns, it will aid the combustion of the briquets 70 around the periphery of the container thus insuring that all the briquets are fully ignited before the container burns away and the cooking process begins with the briquets.

Figure 6:
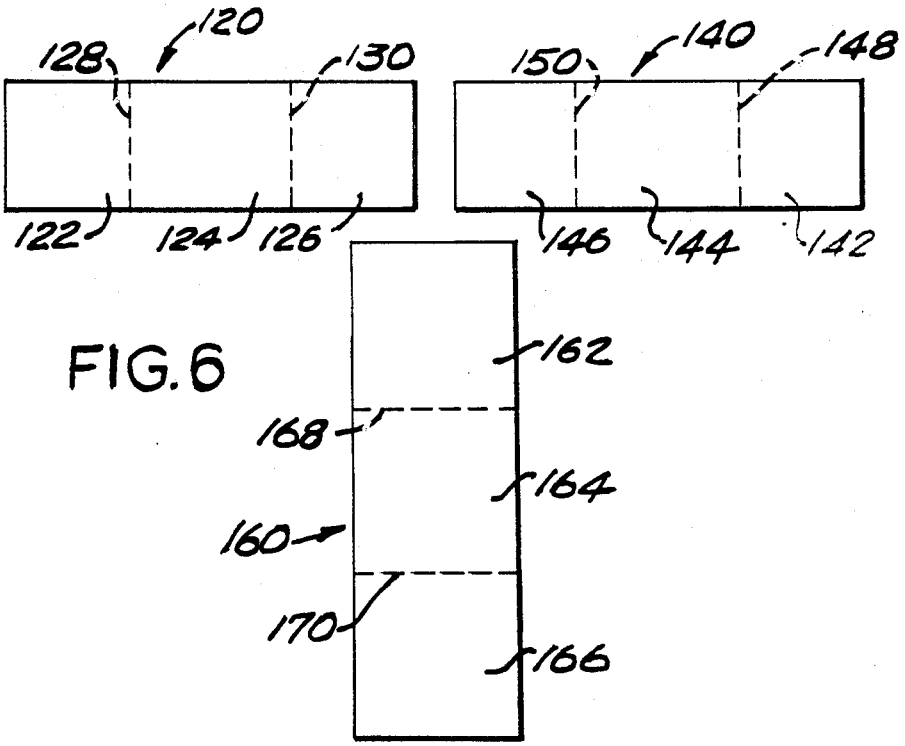
FIG. 6 is a top plan view of three elements which comprise a container of a fuel package according to a second preferred embodiment of the present invention, with the elements being in an unfolded state; and, FIG. 7 is a perspective view of the container of FIG. 6 in an assembled state.

With reference now to a second preferred embodiment of the fuel package, FIG. 6 illustrates a different container for the fuel package. For ease of illustration and appreciation of this embodiment, like components are identified by like numerals with a primed (') suffix and new components are identified by new numerals.

In this figure, a container 110, which is approximately rectangular in shape, is formed from three elements illustrated in an unfolded condition. The first element 120 includes a first panel 122, a second panel 124 and a third panel 126. A pair of respective fold lines 128, 130 are provided between the three panels to enable the first element to be folded into a U-shaped configuration. It can be seen that the second panel 124 is wider than the first and third panels 122, 126.

The container further comprises a second element 140 which includes first, second and third panels 142, 144, 146 as well as a pair of fold lines 148, 150 positioned therebetween. As with the first element, the fold lines enable the second element panels to be folded in relation to one an other so that they can constitute a substanially U-shaped configuration.

The container 110 additionally comprises a third element 160 which includes first, second and third panels 162, 164, 166 as well as a pair of fold lines 168, 170 positioned therebetween. These panels are preferably equally sized to enable the third element to be folded into a U-shaped configuration which will consitute a pair of side walls and a bottom wall for the container.

Figure 7:
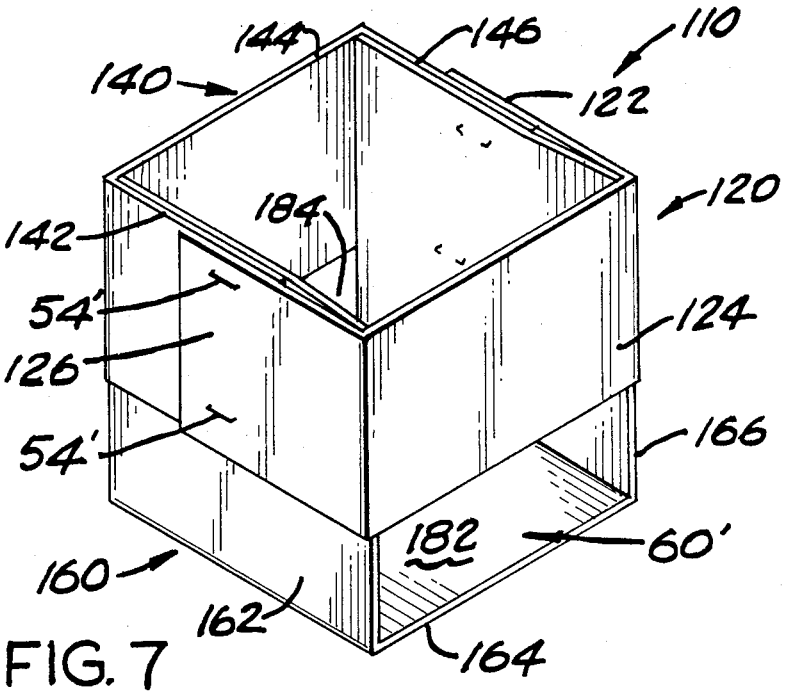

With reference now to FIG. 7, one or more fasteners 54' can be provided in order to secure the first, second and third elements together. The fasteners can be staples or another suitable type of conventional fastener. Two such fasteners 54' can be provided to secure the third panel 126 of the first element 120 to the first panel 142 of the second element 140 as well as the first panel 162 of the third element 160.

When the first element 120 is folded for use it will comprise one complete side wall and portions of the front and back walls of the container. Similarly, the second element 140 will comprise another complete side wall and portions of the front and back walls of the container. The third element 160 when folded will comprise a bottom wall, formed by the second panel 164 thereof, as well as a pair of additional side walls for the container. It is evident from FIG. 7 that because of the way the three elements are secured to each other, a flue means 60' is created near the base of the container. The flue means 60' comprises first and second spaced slots 182, 184 through which air may flow to aid combustion once the fuel package is ignited. The air will flow out through an open top 186 of the container 110.

The container, since it is preferably made from a plurality of panels made of a combustible wood or wood product (such as cardboard or paper) will readily burn away, as will any remnant of the wrapper. Preferably, the panels of the container are appoximately ⅛ to 3/16 inches thick to provide stiffness to the container.

After the container and the wrapper, are burned away, essentially all that is left is the charge of fuel on the charcoal grill 90, as is illustrated in FIG. 4. Then the cooking process can begin.

The invention has been described with reference to preferred embodiments. Obviously, alterations and understanding of this specification. It is intended to include all such modifications and alterations insofar as they come within the scope of the appended claims or the equivalents thereof.

What is claimed is:

1. A fuel package comprising:

a container;

a charge of fuel held in said container; and, an igniting means positioned in said container for igniting said charge of fuel, said igniting means comprising:

a wick, and an ignition element to which said wick is secured, wherein said ignition element consists essentially of a reactive mixture of silica, sodium nitrate, sodium hexafluorosilicate, aluminum and iron oxide.

2. The package of claim 1 wherein said container has four side walls and a bottom wall and comprises:

a first element including front and rear walls and side walls connecting said front and rear walls; and, a second element including front and rear walls and a bottom wall connecting said front and rear walls, said second element being secured to said first element.

3. The package of claim 1 wherein said container has four side walls and a bottom wall and comprises:

a first element including front and rear walls and a side wall connecting said front and rear walls;

a second element including front and rear walls and a side wall connecting said front and rear walls; and, a third element including front and rear walls and a bottom wall connecting said front and rear walls, wherein said first, second and third elements are secured to each other.

4. The package of claim 1 further comprising a wrapper enclosing said container and said charge of fuel held therein.

5. The package of claim 2 wherein said second element bottom wall is narrower than distance between said first element side walls so that a pair of spaced openings is formed in said container adjacent a bottom surface of said container to allow air to flow upwardly through said container and out an open top end thereof.

6. The package of claim 5 wherein said second element is positioned inside said first element so that each of said second element side walls is disposed adjacent to a respective one of said first element side walls and further comprising a fasteing means for securing said second element to said first element.

7. The package of claim 1 further comprising a flue means in said container extending upwardly from a bottom surface of said container.

8. The package of claim 1 wherein said charge of fuel comprises a plurality of loose discrete pieces of fuel located in said container.

9. The package of claim 3 wherein said wrapper is flammable and is substantially dustproof to prevent dust particles of said charge of fuel from escaping from said container.

10. A fuel package comprising:

a combustible fuel;

a container for holding said combustible fuel; and, an ignition element positioned in contact with at least some of said combustible fuel, said ignition element consisting essentially of a reactive mixture which includes in weight percent from about 25 to 65 percent silica, from about 5 to 18 percent sodium nitrate, from about 1 to 8 percent sodium hexafluorosilicate, from about 15 to 40 percent aluminum, and from about 2 to 20 percent iron oxide.

11. The package of claim 10 further comprising an ignition cream applied to at least a portion of a surface of said ignition element, wherein said ignition cream consists essentially of a reactive mixture of from about 1 to 40 percent potassium nitrate, from about 1 to 40 percent sodium nitrate, from about 1 to 40 percent atomized aluminum, from about 10 to 30 percent iron powder, and from about 10 to 50 percent titanium powder.

12. The package of claim 11 wherein said ignition cream further comprises a binder consisting essentially of cellulose acetate.

13. A fuel package comprising: an open topped combustible container comprising a plurality of side walls and a bottom wall connected thereto wherein at least one aperture is provided in said container adjacent said bottom wall for allowing a flow of air vertically through said container;

a charge of fuel held in said container;

a wrapper means for enclosing said container and said fuel held therein; and, an inorganic igniter disposed in said container wherein said igniter consists essentially of a reactive mixture of silica, sodium nitrate, sodium hexafluorosilicate, aluminum, and iron oxide.

14. The package of claim 13 wherein said fuel comprises a plurality of charcoal briquets.

15. The package of claim 13 further comprising a wick connected at one end to said igniter by a connecting means.

16. The package of claim 15 wherein said container walls are made of a substantially flat and relatively stiff wood product and said wrapper means comprises a flexible plastic material.

17. The package of claim 16 wherein said plastic material is transparent so that said fuel and said wick can be seen through an open top of said container.

18. The package of claim 16 wherein said plastic material can be easily torn so that access can be had to said wick for ignition thereof.

19. The package of claim 13 wherein said container is substantially cubical in shape and wherein said igniter is positioned in a center section of said substantially cubical container.

20. The package of claim 19 wherein a pair of spaced slots are provided adjacent said container bottom wall, said slots each extending along an entire side of said container.

21. The package of claim 20 wherein said fuel comprises a plurality of loose discrete pieces of charcoal which are too large to fall out through said bottom wall slots.

22. A method for constructing a self-kindling fuel package comprising:

folding an elongated first housing element into four wall panels;

securing a pair of adjacent wall panels of said first housing element together to form a substantially square structure;

folding an elongated second housing element into three wall panels to form a substantially U-shaped structure;

securing a pair of legs of said second housing element U-shaped structure to respective opposing wall panels of said first housing element square structure to form a container having a bottom wall and four side walls;

filling said container with a charge of fuel;

inserting an igniting means into said charge of fuel in said container; and, subsequently wrapping said container with a wrapping material.

23. The method of claim 22 wherein said container has an open top through which said steps of filling and inserting can take place.

24. The method of claim 22 wherein said igniting means comprises a wick and an igniter body and wherein after said step of inserting said igniting means, it is covered by said charge of fuel such that a distal end of said wick is located atop said charge of fuel.

25. The method of claim 22 wherein said step of securing said second housing element to said first housing element comprises the subsidiary steps of:

inserting said second housing element inside said first housing element; and, fastening said first housing element to said second housing element.

26. The fuel package of claim 1 further comprising an ignition cream applied on a surface of said ignition element and in contact with a portion of said wick for igniting said ignition element, wherein said ignition cream consists essentially of a reactive mixture of potassium nitrate, sodium nitrate, aluminum, iron, and titanium.

27. A fuel package comprising:

a substantially cubical open topped combustible container having four side walls and a bottom wall;

a charge of fuel held in said container;

an igniting means held in said container for igniting said charge of fuel;

at least one aperture provided in said container between two of said walls for allowing a flow of air vertically through said charge of fuel held in said container and out an open top of said container; and, a flexible sheet of wrapper material enclosing said container, together with said charge of fuel and said igniting means held in said container, wherein said sheet also covers said at least one aperture.

* * * * *